US005997723A

United States Patent [19]

Wiehe et al.

[11] Patent Number: 5,997,723

[45] Date of Patent: *Dec. 7, 1999

[54] PROCESS FOR BLENDING PETROLEUM OILS TO AVOID BEING NEARLY INCOMPATIBLE

[75] Inventors: Irwin A. Wiehe, Gladstone; Raymond J. Kennedy, Hampton, both of N.J.

[73] Assignee: Exxon Research and Engineering Company, Florham Park, N.J.

[ * ] Notice: This patent is subject to a terminal disclaimer.

[21] Appl. No.: 09/200,067

[22] Filed: Nov. 25, 1998

[51] Int. Cl.[6] ..... C07C 7/20; C10G 9/16

[52] U.S. Cl. ..... 208/48 R; 585/1; 585/950

[58] Field of Search ..... 208/48 R; 585/1, 585/950

[56] References Cited

U.S. PATENT DOCUMENTS 5,871,634 2/1999 Wiehe et al. ..... 208/48 R

*Primary Examiner*—Bekir L. Yildirim
*Attorney, Agent, or Firm*—Ronald D. Hantman

[57] ABSTRACT

The present invention includes a process for blending two or more petroleum oils, any component of which may be an unprocessed crude oil or a processed oil derived from petroleum, in a manner to minimize fouling and coking of refinery process equipment. The blending method includes the steps of determining the insolubility number, I, for each oil, determining the solubility blending number, S, for each oil, and combining the petroleum oils in the proportions in order to keep the solubility blending number of the mixture higher than 1.4 times the insolubility number of any oil in the mixture. The present invention also includes selecting petroleum oils to minimize fouling.

11 Claims, 1 Drawing Sheet

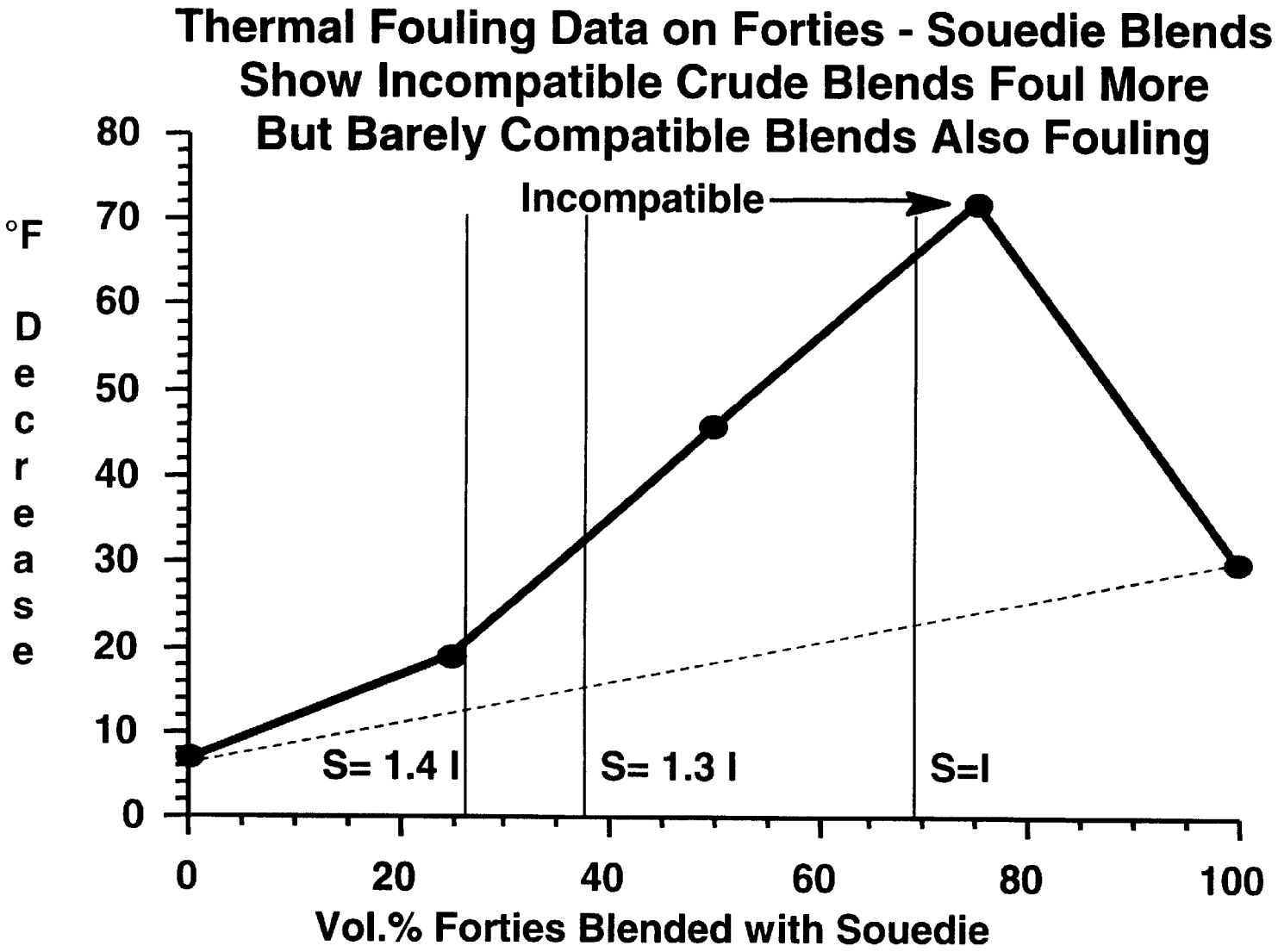
Thermal Fouling Data on Forties - Souedie Blends
Show Incompatible Crude Blends Foul More
But Barely Compatible Blends Also Fouling
Incompatible
S= 1.4 I
S= 1.3 I
S=I
°F Decrease
0
10
20
30
40
50
60
70
80
0
20
40
60
80
100
Vol.% Forties Blended with Souedie

PROCESS FOR BLENDING PETROLEUM OILS TO AVOID BEING NEARLY INCOMPATIBLE

BACKGROUND OF THE INVENTION

The present invention relates to a process for blending two or more petroleum oils to mitigate fouling of refinery equipment, particularly of heat exchangers, by avoiding nearly incompatible blends.

It is well known that petroleum crude oils and asphaltene containing oils derived from petroleum crude oils have the tendency to deposit organic solids, called foulant and coke, on refinery process equipment that contact the oil. Such process equipment include, but are not limited to, pipes, tanks, heat exchangers, furnace tubes, fractionators, and reactors. Even small amounts of foulant or coke results in large energy loss because of much poorer heat transfer through foulant and coke as opposed to metal walls alone. Moderate amounts of foulant and coke cause high pressure drops and interfere with and make process equipment operate inefficiently. Finally, large amounts of foulant or coke plug up process equipment to prevent flow or otherwise making operation intolerable, requiring the equipment to be shut down and cleaned of foulant and coke.

It is also well known that petroleum derived, asphaltene containing oils that have undergone reaction at high temperatures, above 350° C., have a tendency for rapidly fouling process equipment, either on cooling or by blending with a more paraffinic oil. Such processed oils include, but are not limited by, the highest boiling distillation fraction after thermally or catalytically hydrothermally converting atmospheric or vacuum resid of petroleum crude and the highest boiling fraction of the liquid product of fluid catalytic cracking, called cat cracker bottoms or cat slurry oil. This rapid fouling is caused by asphaltenes that become insoluble on cooling or on blending with a more paraffinic oil. Here asphaltenes are defined as the fraction of the oil that is soluble when the oil is blended with 40 volumes of toluene but insoluble when the oil is blended with 40 volumes of n-heptane. If the asphaltenes become insoluble at high temperatures, above 350° C., they rapidly form toluene insoluble coke (see I. A. Wiehe, Industrial & Engineering Chemistry Research, Vol. 32, 2447–2454.). The previous patent application of Wiehe and Kennedy disclosed that the mere blending of two or more unprocessed petroleum crude oils can cause the precipitation of insoluble asphaltenes that can rapidly foul process equipment or when such crude oil blends are rapidly heated above 350° C., the insoluble asphaltenes can coke pipestill furnace tubes. If the blending of oils causes the precipitation of asphaltenes, the oils are said to be incompatible as opposed to compatible oils that do not precipitate asphaltenes on blending. Thus, incompatible blends of oils have a much greater tendency for fouling and coking than compatible oils. Once an incompatible blend of oils is obtained the rapid fouling and coking that results usually requires shutting down the refinery process in a short time. This results in a large economic debit because while the process equipment is cleaned, large volumes of oil cannot be processed. In the past most refineries have learned by trial and error to avoid certain crude oils or not to blend certain processed oils or to reduce the severity of the process in order to make more blendable process oils.

The blending of oils in a refinery is so common, especially for crude oils, that few, if any, refineries can be economically viable without blending oils. This is both done to be able to produce the most economical range of products and to handle the multiple feedstocks at a refinery that arrive at similar times with limited number of storage tanks.

Now, it has been discovered that compatible, but nearly incompatible, blends of oils can foul metal surfaces, particularly heated metal surfaces, at a higher rate than the individual oils in the blend. While the rate of fouling is the highest for incompatible blends, this rate is high for nearly incompatible blends but it decreases as proportions of the blend are selected to be farther and farther from those proportions that result in incompatibility. It also has been discovered that the same oil compatibility model that enabled predicting the proportions of oils in a blend that avoid incompatibility, as taught in the previous application, also enable predicting the proportions of oils in a blend that avoid near incompatibility, albeit using a different criterion.

SUMMARY OF THE INVENTION

The present invention includes a process for blending two or more petroleum oils, any component of which may be an unprocessed crude oil or a processed oil derived from petroleum, in a manner to minimize fouling and coking of refinery process equipment. The blending method includes the steps of determining the insolubility number, I, for each oil, determining the solubility blending number, S, for each oil, and combining said petroleum oils in the proportions in order to keep the solubility blending number of the mixture higher than 1.4 times the insolubility number of any oil in the mixture. The present invention also includes selecting petroleum oils to minimize fouling.

BRIEF DESCRIPTION OF THE DRAWINGS

FIG. 1 shows a measure of thermal fouling data using a Thermal Fouling Test Unit for a mixture of oils in Example 1.

BRIEF DESCRIPTION OF THE INVENTION

In the present invention it has been discovered that two or more tests of each petroleum oil with a test liquid containing different proportions of a nonpolar asphaltene solvent and of a nonpolar asphaltene nonsolvent enables predicting if a given blend of oils are nearly incompatible. This is based upon determining the insolubility number and the solubility blending number for each petroleum oil in the blend using the petroleum oil tests. Here we mean nonpolar when the molecular structure of the liquid only includes atoms of carbon, hydrogen, and sulfur. Once more, it has been learned that nearly incompatible oils can be processed with little fouling or coking as long as certain proportions of the oils in the blend are avoided, as also are predicted by the insolubility number and the solubility blending number of each oil in the blend as determined by the oil tests.

The first step in determining the insolubility number and the solubility blending number for a petroleum oil is to establish if the petroleum oil contains n-heptane insoluble asphaltenes. This is accomplished by blending 1 volume of the oil with 5 volumes of n-heptane and determining if asphaltenes are insoluble. Any convenient method might be used. One possibility is to observe a drop of the blend of test liquid mixture and oil between a glass slide and a glass cover slip using transmitted light with an optical microscope at a magnification of from 50 to 600×. If the asphaltenes are in solution, few, if any, dark particles will be observed. If the asphaltenes are insoluble, many dark, usually brownish, particles, usually 0.5 to 10 microns in size, will be observed. Another possible method is to put a drop of the blend of test liquid mixture and oil on a piece of filter paper and let dry.

If the asphaltenes are insoluble, a dark ring or circle will be seen about the center of the yellow-brown spot made by the oil. If the asphaltenes are soluble, the color of the spot made by the oil will be relatively uniform in color. If the petroleum oil is found to contain n-heptane insoluble asphaltenes, the procedure described in the next three paragraphs is followed for determining the insolubility number and the solubility blending number. If the petroleum oil is found not to contain n-heptane insoluble asphaltenes, the insolubility number is assigned a value of 0 and the solubility blending number is determined by the procedure described in the section labeled, "Petroleum Oils without Asphaltenes".

Asphaltene Containing Petroleum Oils

The determination of the insolubility number and the solubility blending number for a petroleum oil containing asphaltenes requires testing the solubility of the oil in test liquid mixtures at the minimum of two volume ratios of oil to test liquid mixture. The test liquid mixtures are prepared by mixing two liquids in various proportions. One liquid is nonpolar and a solvent for the asphaltenes in the oil while the other liquid is nonpolar and a nonsolvent for the asphaltenes in the oil. Since asphaltenes are defined as being insoluble in n-heptane and soluble in toluene, it is most convenient to select the same n-heptane as the nonsolvent for the test liquid and toluene as the solvent for the test liquid. Although the selection of many other test nonsolvents and test solvents can be made, there use provides no better definition of the preferred oil blending process than the use of n-heptane and toluene described here.

A convenient volume ratio of oil to test liquid mixture is selected for the first test, for instance, 1 ml. of oil to 5 ml of test liquid mixture. Then various mixtures of the test liquid mixture are prepared by blending n-heptane and toluene in various known proportions. Each of these is mixed with the oil at the selected volume ratio of oil to test liquid mixture. Then it is determined for each of these if the asphaltenes are soluble or insoluble. Any convenient method might be used. One possibility is to observe a drop of the blend of test liquid mixture and oil between a glass slide and a glass cover slip using transmitted light with an optical microscope at a magnification of from 50 to 600×. If the asphaltenes are in solution, few, if any, dark particles will be observed. If the asphaltenes are insoluble, many dark, usually brownish, particles, usually 0.5 to 10 microns in size, will be observed. Another possible method is to put a drop of the blend of test liquid mixture and oil on a piece of filter paper and let dry. If the asphaltenes are insoluble, a dark ring or circle will be seen about the center of the yellow-brown spot made by the oil. If the asphaltenes are soluble, the color of the spot made by the oil will be relatively uniform in color. The results of blending oil with all of the test liquid mixtures are ordered according to increasing percent toluene in the test liquid mixture. The desired value will be between the minimum percent toluene that dissolves asphaltenes and the maximum percent toluene that precipitates asphaltenes. More test liquid mixtures are prepared with percent toluene in between these limits, blended with oil at the selected oil to test liquid mixture volume ratio, and determined if the asphaltenes are soluble or insoluble. The desired value will be between the minimum percent toluene that dissolves asphaltenes and the maximum percent toluene that precipitates asphaltenes. This process is continued until the desired value is determined within the desired accuracy. Finally, the desired value is taken to be the mean of the minimum percent toluene that dissolves asphaltenes and the maximum percent toluene that precipitates asphaltenes. This is the first datum point, $T_1$, at the selected oil to test liquid mixture volume ratio, $R_1$.

The second datum point can be determined by the same process as the first datum point, only by selecting a different oil to test liquid mixture volume ratio. Alternatively, a percent toluene below that determined for the first datum point can be selected and that test liquid mixture can be added to a known volume of oil until asphaltenes just begin to precipitate. At that point the volume ratio of oil to test liquid mixture, $R_2$, at the selected percent toluene in the test liquid mixture, $T_2$, becomes the second datum point. Since the accuracy of the final numbers increase as the further apart the second datum point is from the first datum point, the preferred test liquid mixture for determining the second datum point is 0% toluene or 100% n-heptane.

The insolubility number, I, is given by:

$$I = T_2 - \left[\frac{T_2 - T_1}{R_2 - R_1}\right] R_2$$

and the solubility blending number, S, is given by:

$$S = I\left[1 + \frac{1}{R_2}\right] - \frac{T_2}{R_2}$$

Petroleum Oils without Asphaltenes

If the petroleum oil contains no asphaltenes, the insolubility number is zero. However, the determination of the solubility blending number for a petroleum oil not containing asphaltenes requires using a test oil containing asphaltenes for which the insolubility number and the solubility blending numbers have previously been determined, using the procedure just described. First, 1 volume of the test oil is blended with 5 volumes of the petroleum oil. Insoluble asphaltenes may be detected by the microscope or spot technique, described above. If the oils are very viscous (greater than 100 centipoises), they may be heated to 100° C. during blending and then cooled to room temperature before looking for insoluble asphaltenes. Also, the spot test may be done on a blend of viscous oils in an oven at 50–70° C. If insoluble asphaltenes are detected the petroleum oil is a nonsolvent for the test oil and the procedure in the next paragraph should be followed. However, if no insoluble asphaltenes are detected, the petroleum oil is a solvent for the test oil and the procedure in the paragraph following the next paragraph should be followed.

If insoluble asphaltenes were detected when blending 1 volume of the test oil with 5 volumes of the petroleum oil, small volume increments of the petroleum oil are added to 5 ml. of the test oil until insoluble asphaltenes are detected. The volume of nonsolvent oil, $V_{NSO}$, is equal to the average of the total volume of the petroleum oil added for the volume increment just before insoluble asphaltenes are detected and the total volume added when insoluble asphaltenes were first detected. The size of the volume increment may be reduced to that required for the desired accuracy. If $S_{TO}$ is the solubility blending number of the test oil and $I_{TO}$ is the insolubility number of the test oil, then the solubility blending number of the nonsolvent oil, S, is given by:

$$S = I_{TO} - \frac{5[S_{TO} - I_{TO}]}{V_{NSO}}$$

If insoluble asphaltenes were not detected when blending 1 volume of the test oil with 5 volumes of the petroleum oil, the petroleum oil is a solvent oil for the test oil. The same oil to test liquid mixture volume ratio, $R_{TO}$, as was used to measure the insolubility number and solubility blending number for the test oil is selected. However, now various mixtures of the test liquid are prepared by blending different known proportions of the petroleum oil and n-heptane instead of toluene and n-heptane. Each of these is mixed with the test oil at a volume ratio of oil to test liquid mixture equal to $R_{TO}$. Then it is determined for each of these if the asphaltenes are soluble or insoluble, such as by the microscope or the spot test methods discussed previously. The results of blending oil with all of the test liquid mixtures are ordered according to increasing percent petroleum oil in the test liquid mixture. The desired value will be between the minimum percent petroleum oil that dissolves asphaltenes and the maximum percent petroleum oil that precipitates asphaltenes. More test liquid mixtures are prepared with percent petroleum oil in between these limits, blended with the test oil at the selected test oil to test liquid mixture volume ratio ($R_{TO}$) and determined if the asphaltenes are soluble or insoluble. The desired value will be between the minimum percent petroleum oil that dissolves asphaltenes and the maximum percent petroleum oil that precipitates asphaltenes. This process is continued until the desired value is determined within the desired accuracy. Finally, the desired value is taken to be the mean of the minimum percent petroleum oil that dissolves asphaltenes and the maximum percent petroleum oil that precipitates asphaltenes. This is the datum point, $T_{SO}$, at the selected test oil to test liquid mixture volume ratio, $R_{TO}$. If $T_{TO}$ is the datum point measured previously at test oil to test liquid mixture volume ratio, $R_{TO}$, on the test oil with test liquids composed of different ratios of toluene and n-heptane, then the solubility blending number of the petroleum oil, S, is given by:

$$S = 100\left[\frac{T_{TO}}{T_{SO}}\right]$$

Mixtures of Petroleum Oils

Once the solubility blending number is determined for each component, the Solubility Blending Number for a mixture of n oils, $S_{mix}$, is given by:

$$S_{mix} = \frac{V_1S_1 + V_2S_2 + V_3S_3 + \ldots + V_nS_n}{V_1 + V_2 + V_3 + \ldots + V_n}$$

where $V_1$ is the volume of component 1 in the mixture.

U.S. Ser. No. 763,652 (now allowed) taught that the criterion for compatibility for a mixture of petroleum oils is that the solubility blending number of the mixture of oils is greater than the insolubility number of any component in the mixture. In this application the criterion for low fouling is that the solubility blending number of the mixture of oils is greater than 1.3 times, and preferably greater than 1.4 times, the insolubility number of any component in the mixture. The greatest rate of fouling is when the solubility blending number of the mixture is less than the insolubility number of at least one component in the mixture, thus incompatible oils. However, surprisingly, it has been discovered that even compatible oil blends can be high fouling if the solubility blending number of the mixture of oils is less than 1.3 times the insolubility number of at least one component in the mixture. Only when the solubility blending number of the mixture of oils is greater than 1.4 times the insolubility number of any component in the mixture is the fouling rate about what is expected based on a linear blend of the fouling rates of the individual components of the blend. If the lowest solubility blending number of all the components in the blend is greater than the highest insolubility number of all the components in the blend, the order of blending is not important. Otherwise, the order of blending as taught by the previous patent needs to be practiced for low rate of fouling.

If none of the oils in a proposed blend has a solubility blending number greater than 1.3, preferably 1.4, times the maximum insolubility blending number of the components in the blend, clearly no proportions of the oils on blending will meet the criterion for low fouling, as long as all the oils are present. In this case the choice is either to remove the oil of maximum insolubility number from the blend or add an oil to the blend that has a solubility blending number of greater than 1.3, preferably greater than 1.4, times the maximum insolubility number of the components in the blend.

EXAMPLE

The fouling of Forties and Souedie crude oils and various blends of these two crude oils were measured on heated surfaces. First the insolubility number and solubility blending number of each crude oil was measured following the procedure for asphaltene containing petroleum oils. The minimum percent toluene in the test liquid to keep asphaltenes in solution, $T_1$, was determined to be 7.5 for Forties and 33 for Souedie at 1 gram of oil and 5 ml. of test liquid composed of mixtures of toluene and n-heptane. Since the density of Forties is 0.791 g./ml. and for Souedie is 0.874 g./ml., $R_1$ is 1/[(0.791)5]=0.252 for Forties and 1/[(0.874)(5)]=0.229 for Souedie. The maximum n-heptane that could be added to 5 ml. of oil without precipitating asphaltenes was determined to be 6.9 ml. for Forties and 3.1 ml. for Souedie. Thus, $T_2$ is zero at $R_2$ equal to 5/6.9=0.725 for Forties and 5/3.1=1.61 for Souedie. Therefore:

$$I = T_2 - \left[\frac{T_2 - T_1}{R_2 - R_1}\right]R_2$$

$$I = 0 - \left[\frac{0 - 7.5}{.725 - .252}\right].725; \quad I = 0 - \left[\frac{0 - 33}{1.61 - .229}\right]1.61$$

$$I = 11.5 \text{ for Forties}; \quad I = 38.5 \text{ for Souedie}$$

$$S = I\left[1 + \frac{1}{R_2}\right] - \frac{T_2}{R_2}$$

$$S = 11.5\left[1 + \frac{1}{.725}\right] - \frac{0}{.725}; \quad S = 38.5\left[1 + \frac{1}{1.61}\right] - \frac{0}{1.61}$$

$$S = 27 \text{ for Forties}; \quad S = 62 \text{ for Souedie}$$

Since the insolubility number of Souedie crude is greater than the solubility blending number of Forties crude, these two crudes are potentially incompatible. The onset of incompatibility occurs when:

$$S_{mix} = \frac{V_FS_F}{V_F + V_S} + \frac{V_SS_S}{V_F + V_S} = I_{\max} = 38.5$$

$$38.5 = \frac{27V_F}{V_F + V_S} + 64\left[1 - \frac{V_F}{V_F + V_S}\right]$$

$$\frac{V_F}{V_F + V_S} = 0.69$$

Thus, any mixture of Forties and Souedie that is greater than 69% by volume Forties will precipitate asphaltenes on blending.

For a solubility blending number that is 1.3 times the insolubility number:

$$S_{mix} = \frac{V_FS_F}{V_F + V_S} + \frac{V_SS_S}{V_F + V_S} = 1.3I_{\max} = 50.0$$

-continued $$50.0 = \frac{27V_F}{V_F + V_S} + 64\left[1 - \frac{V_F}{V_F + V_S}\right]$$

$$\frac{V_F}{V_F + V_S} = 0.38$$

For a solubility blending number that is 1.4 times the insolubility number:

$$S_{mix} = \frac{V_F S_F}{V_F + V_S} + \frac{V_S S_S}{V_F + V_S} = 1.4 I_{max} = 53.9$$

$$53.9 = \frac{27V_F}{V_F + V_S} + 64\left[1 - \frac{V_F}{V_F + V_S}\right]$$

$$\frac{V_F}{V_F + V_S} = 0.27$$

The relative fouling rate of Forties crude oil, Souedie crude oil, and mixtures of Forties and Souedie crude oils were measured using a laboratory Thermal Fouling Test Unit manufactured by Alcor. In each case the oil, under 700 psig. nitrogen pressure to prevent boiling, was pumped at 3 ml./min. through an annulus in which a carbon steel rod in the center was heated at a constant temperature of 760° F. As foulant built up on the rod surface, the insulating effect of the foulant reduced the ability to heat the flowing oil and caused the temperature at the outlet of the annulus to decrease. Therefore, the decrease in temperature of the flowing oil at the annulus outlet over a 3 hour period is a measure of the fouling rate of the oil. The data in the Table and Figure show how this measure of fouling rate varied with volume percent Forties crude when blended with Souedie crude.

| Vol % Forties | Insolubility Number | Solubility Blend. No. | Sol. Bl. No. / Insol. No. | Temp., ° F., Decrease | Linear Temp. Decr |
|---|---|---|---|---|---|
| 0 | 38.5 | 62 | 1.61 | 7 | 7 |
| 25 | 38.5 | 53 | 1.38 | 19 | 12.8 |
| 50 | 38.5 | 44 | 1.14 | 46 | 18.5 |
| 75 | 38.5 | 36 | 0.93 | 72 | 24.2 |
| 100 | 11.5 | 27 | 2.35 | 30 | 30 |

The fouling rate at 25% Forties is only slightly higher than expected from a line drawn through the points at 0% Forties (only Souedie) and 100% Forties. Since at 75% Forties the blend is incompatible (higher than 69% Forties), it is not surprising that the fouling rate is the highest measured for this set. The surprise is that the rate of fouling at 50% Forties is higher than the rate of fouling of either component of the blend even though this blend is compatible. If Forties and Souedie blends were controlled at a solubility blending number of the mixture greater than 1.3 times the insolubility number, the blends would always be less than 38% Forties. This would be a large reduction in the fouling rate compared with 69% Forties at the edge of incompatibility (solubility blending number of the mixture equal to insolubility number). In addition, the fouling rate would never be much higher than the fouling rate of Forties crude alone. However, If Forties and Souedie blends were controlled at a solubility blending number of the mixture greater than 1.4 times the insolubility number the blends would always be less than 27% Forties. This would be a fouling rate close to the linear prediction based on the fouling of components. Thus, controlling the solubility blending number of an oil to be greater than 1.4 times the insolubility blending number should keep the organic fouling rate almost as low as can be expected, given the fouling rate of the pure components of the mixture.

What is claimed is:

1. A process for blending two or more petroleum oils, any component of which may be an unprocessed crude oil or a processed oil derived from petroleum, in a manner to minimize fouling and coking of refinery process equipment comprising:

(a) determining the insolubility number, I, for each oil.

(b) determining the solubility blending number, S, for each oil; and (c) combining said petroleum oils such that the solubility blending number of the mixture is always higher than 1.4 times the insolubility number of any oil in the mixture.

2. The process of claim 1 wherein the proportions of oils in the blend are selected to keep the solubility blending number of the mixture higher than 1.3 times the insolubility number of any oil in the mixture.

3. The method of claim 1 wherein the insolubility number and the solubility blending number are determined from the toluene equivalence test and the heptane dilution test for each oil containing asphaltenes.

4. The method of claim 1 wherein the insolubility number is zero and the solubility blending number is determined from either the solvent oil equivalence test or the nonsolvent oil dilution test for each oil containing no asphaltenes.

5. The method of claim 1 wherein said solubility blending number of the mixture is determined by $$S_{mix} = \frac{V_1 S_1 + V_2 S_2 + V_3 S_3 + \ldots + V_n S_n}{V_1 + V_2 + V_3 + \ldots + V_n}$$

where $V_1$ is the volume of oil 1 and $S_1$ is the solubility blending number of oil 1.

6. A method for selecting a petroleum oil for blending with an oil or a mixture of oils that would otherwise be nearly incompatible to minimize fouling and coking in subsequent processing comprising selecting said oil for blending such that it has a solubility blending number higher than 1.4 times the insolubility number of any oil in the mixture and an insolubility number lower than at least one other oil in the mixture.

7. The method of claim 6 wherein said oil for blending has a solubility blending number higher than 1.3 times the insolubility number of any oil in the mixture.

8. The method of claim 6 wherein said oil for blending selected has the highest solubility blending number of the oils under consideration, an insolubility number lower than at least one other oil in the mixture.

9. The method of claim 6 wherein said solubility blending number of the mixture is determined by $$S_{mix} = \frac{V_1 S_1 + V_2 S_2 + V_3 S_3 + \ldots + V_n S_n}{V_1 + V_2 + V_3 + \ldots + V_n}$$

where $V_1$ is the volume of oil 1 and $S_1$ is the solubility blending number of oil 1.

10. The method of claim 6 wherein the insolubility number and the solubility blending number are determined from the toluene equivalence test and the heptane dilution test for each oil containing asphaltenes.

11. The method of claim 6 wherein the insolubility number is zero and the solubility blending number is determined from either the solvent oil equivalence test or the nonsolvent oil dilution test for each oil containing no asphaltenes.

* * * * *